US007177575B2

(12) United States Patent
Okabe

(10) Patent No.: US 7,177,575 B2
(45) Date of Patent: Feb. 13, 2007

(54) IMAGE FORMING APPARATUS

(75) Inventor: Yasushi Okabe, Nagoya (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 10/953,950

(22) Filed: Sep. 30, 2004

(65) Prior Publication Data

US 2005/0069347 A1 Mar. 31, 2005

(30) Foreign Application Priority Data

Sep. 30, 2003 (JP) ..... 2003-340899

(51) Int. Cl.
*G03G 15/01* (2006.01)

(52) U.S. Cl. ..... 399/228; 399/234; 399/119

(58) Field of Classification Search ..... 399/228, 399/234, 112

See application file for complete search history.

(56) References Cited

U.S. PATENT DOCUMENTS 5,598,255 A * 1/1997 De Cock et al. ..... 399/234
6,522,850 B2 2/2003 Hiroki
6,535,708 B2 * 3/2003 Hashimoto et al. ..... 399/228
6,694,118 B2 * 2/2004 Yoo ..... 399/228
2003/0007808 A1 * 1/2003 Hiroki ..... 399/228
2003/0053824 A1 * 3/2003 Hiroki et al. ..... 399/228

FOREIGN PATENT DOCUMENTS

| | | | |
|---|---|---|---|
| JP | A 61-1515561 | | 7/1986 |
| JP | A 4-1669 | | 1/1992 |
| JP | A 09-179475 | | 7/1997 |
| JP | A 2001-154454 | | 6/2001 |
| JP | 2002-023448 | * | 1/2002 |
| JP | A 2002-023448 | | 1/2002 |
| JP | A 2003-021944 | | 1/2003 |

* cited by examiner

*Primary Examiner*—David M. Gray
*Assistant Examiner*—Joseph S. Wong
(74) *Attorney, Agent, or Firm*—Oliff & Berridge, PLC

(57) ABSTRACT

An image forming apparatus includes a main body; a photosensitive member on which a latent image is formed; a cartridge detachably attached to the main body and accommodates a developing agent therein; a developing roller provided at the cartridge, the developing roller being movable between a first position where the latent image is developed and a second position where development is not performed; a support shaft that rotatably supports the developing roller; and a separation member that moves the developing roller from the first position to the second position by engagement with the support shaft.

17 Claims, 11 Drawing Sheets

IMAGE FORMING APPARATUS

INCORPORATION BY REFERENCE

This application claims priority from Japanese Patent Application No. 2003-340899, filed Sep. 30, 2003, the subject matter of which is incorporated herein in its entirety by reference thereto.

BACKGROUND OF THE INVENTION

1. Field of Invention

The invention relates to an image forming apparatus that moves a developing roller to a development position during image development in order to form a visible image on a photosensitive member using a developing agent.

2. Description of Related Art

Conventionally, in an image forming apparatus that prints images, such as copying machines and printers, a developing roller of a cartridge containing a developing agent is moved between a development position and a separation position. An electrostatic latent image formed on a photosensitive member is developed into a developing agent image, and then transferred onto a recording medium.

In order to move the developing roller between the development position and the separation position, as disclosed in Japanese Laid-Open Patent Publication No. 2002-23448, a cartridge containing a developing agent corresponding to each color is urged by a spring toward the development position where the developing roller contacts the photosensitive member. In addition, a link mechanism is provided. When a pin, which is held upright relative to the cartridge, is brought into engagement with a lift lever that is moved up and down via a link mechanism, the cartridge is lifted and the developing roller is moved to the separation position away from the photosensitive member. Furthermore, there is also provided a selection mechanism where a selection bar is formed with a plurality of grooves with which the pin of the cartridge corresponding to each color is engaged. The selection bar is moved via the link mechanism to select the cartridge lifted by the link mechanism and the developing roller of the selector cartridge is moved to the development position.

SUMMARY OF THE INVENTION

However, the conventional image forming apparatus has a problem in that an interval between the photosensitive member and the developing roller varies greatly because the pin is held upright relative to the cartridge. That is, because many parts are assembled after the developing roller is rotatably assembled to the cartridge and the pin is held upright relative to the cartridge, dimensional errors of individual parts are accumulated. The accumulated dimensional errors create a wide range of variations in the distance from the developing roller to the pin in the cartridge. For that reason, for example, when the developing agent is used up and the cartridge needs replacement, the interval between the photosensitive member and the developing roller should be kept even if there are variations. Thus, a distance for which the developing roller is separated should be sufficiently kept in consideration of the maximum variation that is likely to happen.

The invention thus, among other things, minimizes a variation in an interval between a photosensitive member and a developing roller when they are separated from each other.

According to an exemplary aspect of the invention, an image forming apparatus is provided with a main body; a photosensitive member on which a latent image is formed; a cartridge detachably attached to the main body and accommodates a developing agent therein; a developing roller provided at the cartridge, the developing roller being movable between a first position where the latent image is developed and a second position where development is not performed; a support shaft that rotatably supports the developing roller; and a separation member that moves the developing roller from the first position to the second position by engagement with the support shaft.

Accordingly to another exemplary aspect of the invention, an image forming apparatus is provided with a main body; a photosensitive belt on which a latent image is formed; a plurality of cartridges each detachably attached to the main body, each of the plurality of cartridges accommodating a different developing agent; a plurality of developing rollers each provided at a corresponding one of the plurality of cartridges, each of the plurality of the developing rollers being movable between a first position where the latent image is developed and a second position where development is not performed; a plurality of support shafts that each rotatably support a corresponding one of the plurality of developing rollers; and a plurality of separation mechanisms each moving the corresponding one of the plurality of developing rollers from the first position to the second position by engagement with a corresponding one of the plurality of support shafts.

BRIEF DESCRIPTION OF THE DRAWINGS

Various embodiments of the invention will be described in detail with reference to the following figures, wherein.

DETAILED DESCRIPTION OF PREFERRED EMBODIMENTS

An embodiment of the invention will be described in detail with reference to the accompanying drawings.

Figure 1:
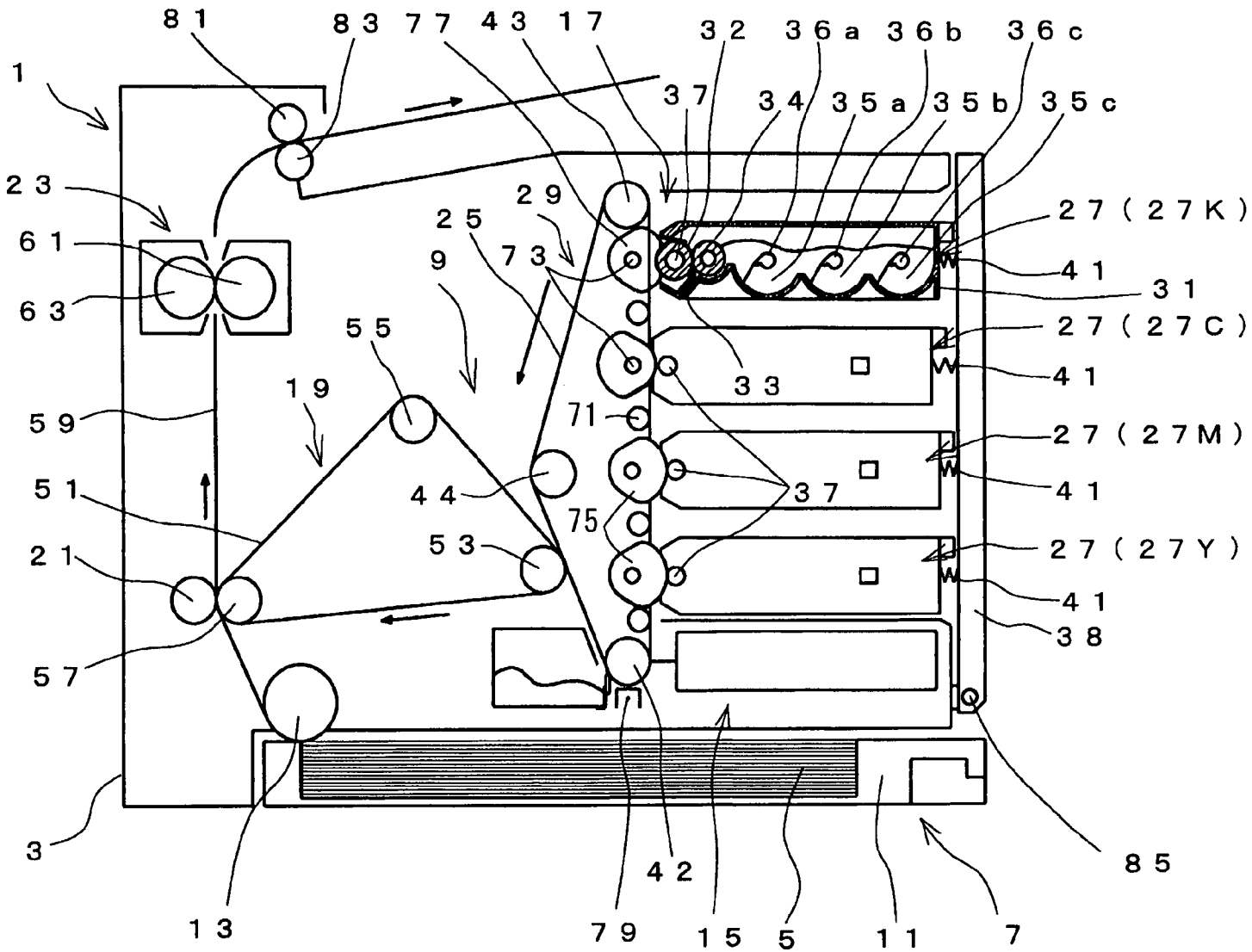
FIG. 1 is a side sectional view of essential parts of a color laser printer as an image forming apparatus according to an embodiment of the invention.

As shown in FIG. 1, a color laser printer 1 as an image forming apparatus includes, in a main body frame 3, a sheet feeding unit 7 that supplies sheets 5 as a recording medium, and an image forming part 9 that performs image formation on the sheets 3 fed therein. The sheet feeding unit 7 includes a sheet supply tray 11 where sheets 5 are stacked, and a sheet supply roller 13 which contacts an upper most sheet of the sheet supply tray 11 and takes out a sheet one by one while rotating.

The image forming part 9 includes a scanner unit 15, a process unit 17, a transfer belt mechanism part 19, a transfer roller 21, and a fixing part 23. The scanner unit 15 is disposed at a lower portion in the main body frame 3 and includes a laser emitting portion, a polygon mirror, and a plurality of lenses, which are not shown. In the scanner unit 15, a laser beam from the laser emitting portion, based on print data, is directed to a surface of a photosensitive belt 25 via the polygon mirror and the lenses by high speed scanning.

The process unit 17 includes four cartridges 27 and a photosensitive belt mechanism part 29. The four cartridges 27 are a yellow cartridge 27Y containing yellow toner, a magenta cartridge 27M containing magenta toner, a cyan cartridge 27C containing cyan toner, and a black cartridge 27K containing black toner, which are vertically disposed at established intervals in the order from bottom to top, in this example, within the main body frame 3.

Each cartridge 27 is identical in shape, structure and operation, and includes a cartridge case 31, a developing roller 32, a layer thickness regulating blade 33, a supply roller 34, a plurality of toner accommodating portions 35*a*–35*c*, and a plurality of agitating members 36*a*–36*c* that agitate toner in the toner accommodating portions 35*a*–35*c*.

The developing roller 32 has a metallic support shaft 37 therein, and is made by covering the support shaft 37 with a conductive rubber material. More specifically, the developing roller 32 is provided by a two-tier structure of an elastic member layer and a coat layer that covers the surface of the elastic member layer. The elastic member layer is made of conductive rubber, which includes carbon particles, such as urethane rubber, silicone rubber, and ethylene-propylene-diene-terpolymer (EPDM) rubber. The coat layer is made of urethane rubber, urethane resin, polyimide resin or other materials as a main intergradient.

Figure 3A:
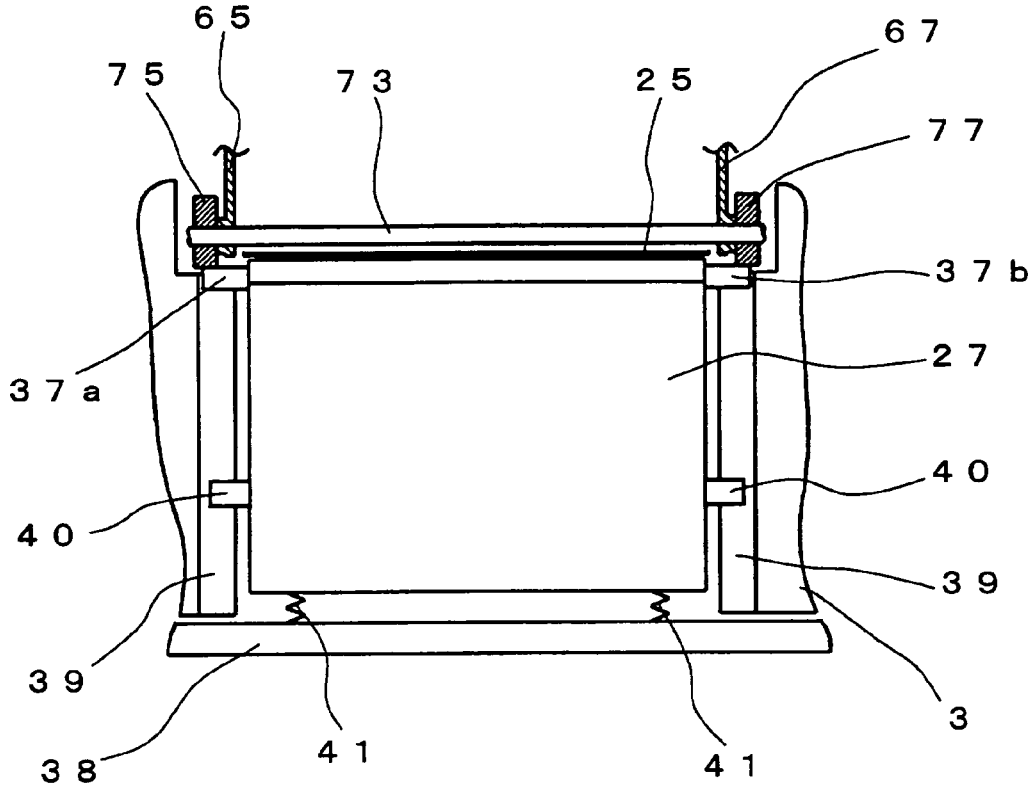
FIGS. 3A and 3B are sectional views taken along a longitudinal direction of a cartridge inserted into grooves.
Figure 3B:
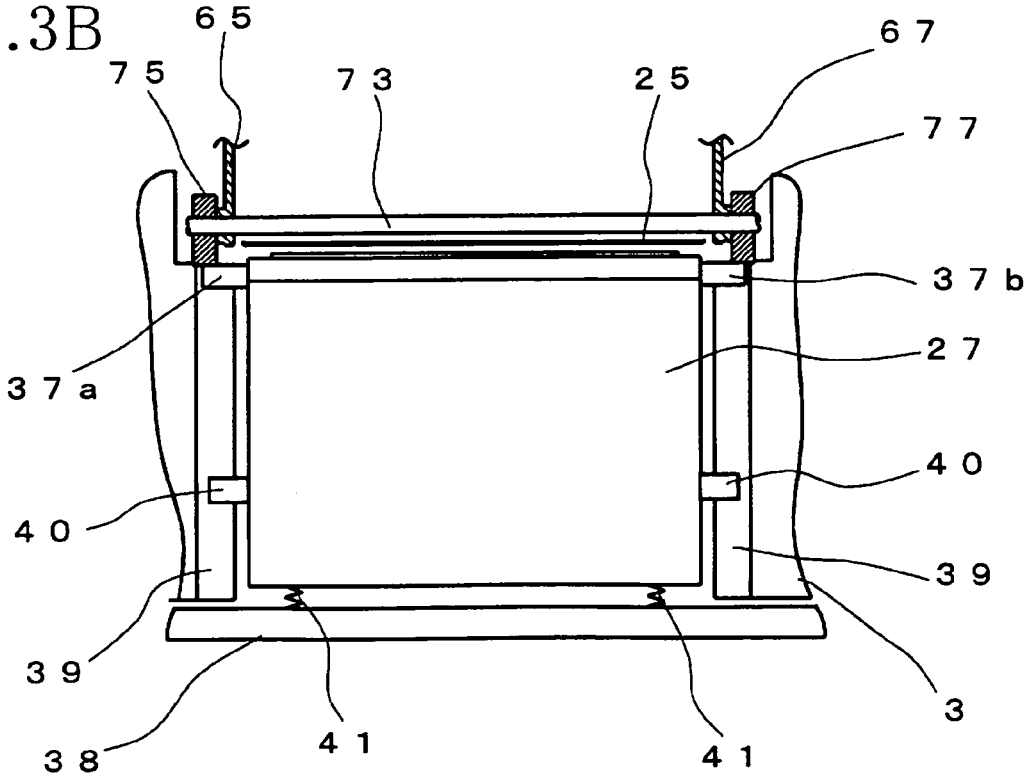

The support shaft 37 is rotatably supported by the cartridge case 31 and extends outside of the cartridge case 31. The support shaft 37 is provided with projecting portions 37*a*, 37*b* at both ends as shown in FIGS. 3A and 3B. During image development, a development bias is applied to the developing roller 32 with respect to the photosensitive belt 25. For example, the development bias is set to +300V.

Each cartridge 27 contains, in the toner accommodating portions 35*a*–35*c*, nonmagnetic single-component polymerized toner of a color of yellow, magenta, cyan, and black that is to be positively charged, as a developing agent. Each toner accommodating portion 35*a*–35*c* is provided with a corresponding one of the agitating members 36*a*–36*c*.

Toner is agitated and conveyed to the supply roller 34 with rotation of the agitating members 36*a*–36*c*, then conveyed to the developing roller 32 with rotation of the supply roller 34, and positively charged between the supply roller 34 and the developing roller 32. Further, the toner supplied to the developing roller 32 goes in between the layer thickness regulating blade 33 and the developing roller 32 along with the rotation of the developing roller 32, is sufficiently charged by friction therebetween, uniformly regulated to a specified thickness, and carried on the developing roller 32 as a thin layer.

Figure 2:
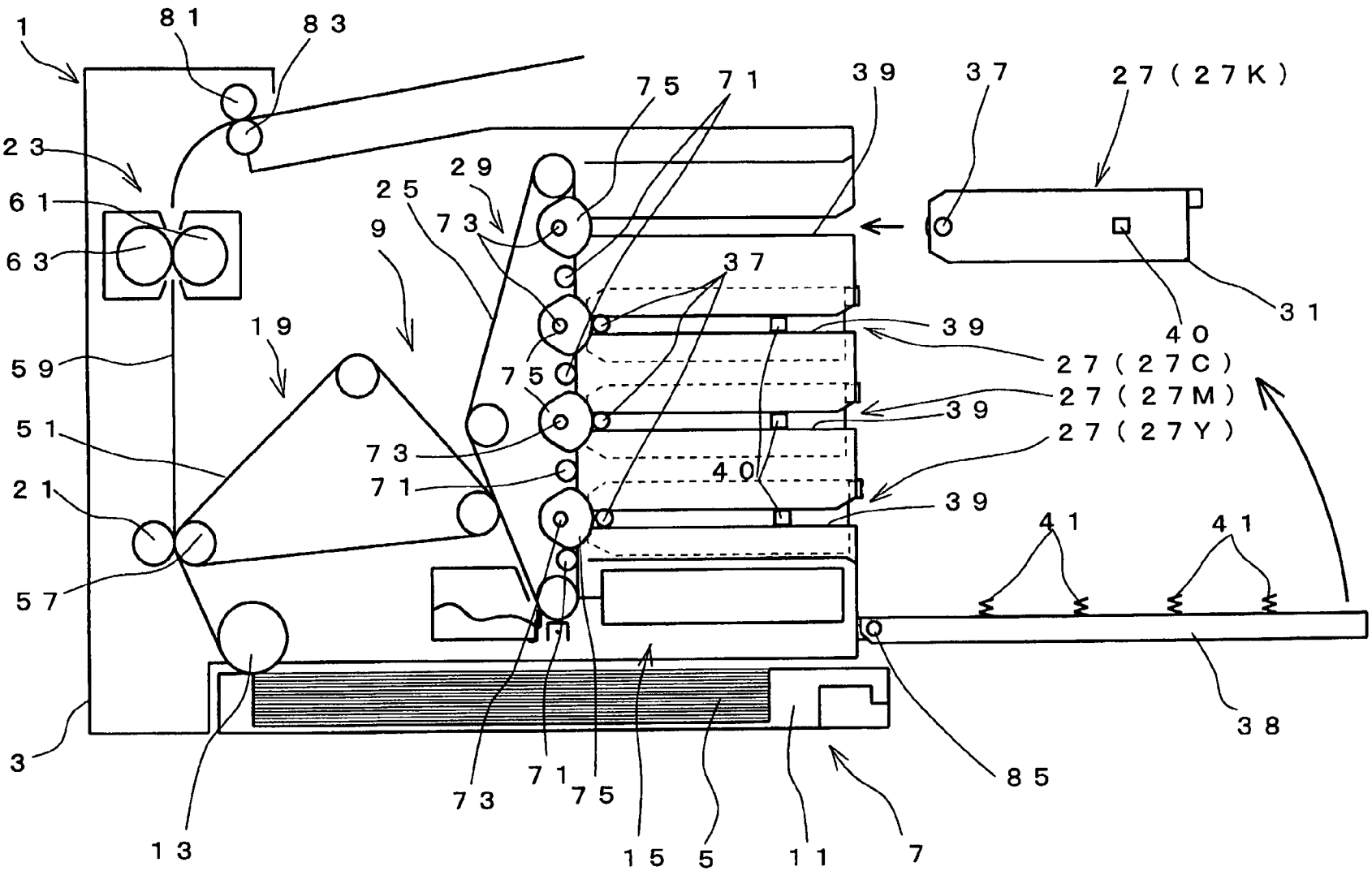
FIG. 2 is a schematic view showing cartridges that are mounted in the color laser printer.

Each cartridge 27 is detachably attached to the main body frame 3. A lid member 38 is pivotally supported by the main body frame 3 via a pivot pin 85 at a rear side of the main body frame 3. A side of the main body frame 3 is opened by opening the lid member 38 as shown in FIG. 2.

In the main body frame 3, a groove 39, which communicates with an opening of the rear side, is formed horizontally till it reaches close to the photosensitive belt 25. In other words, the length of the groove 39 is provided until the developing roller 32 contacts the photosensitive belt 25. In the embodiment, the main body frame 3 comprises a number of grooves 39, in this example, four grooves 39, which are spaced away at established intervals in a vertical direction, on each side surface. The intervals are provided such that the four cartridges 27 can be arranged in parallel with each other in the vertical direction.

The grooves 39 have a width that accommodates the projecting portions 37*a*, 37*b* of the support shaft 37 so that they can be slidably inserted. The cartridge case 31 is formed with protrusions 40 on both side surfaces, which can be inserted into the grooves 39. The cartridge 27 can be moved toward the photosensitive belt 25 by inserting the projecting portions 37*a*, 37*b* and the protrusions 40 into the grooves, so that the developing roller 32 can be brought into contact with the photosensitive belt 25.

The lid member 38 is provided with four elastic members 41 such as coil springs, spiral springs, and rubber. After the cartridges 27 are inserted into the main body frame 3, the lid member 38 is rotated around the pivot pin 85 in the closed stated, and locked to the main body frame 3 by a hook (not shown). With this state, each elastic member 41 is structured such as to urge the corresponding cartridge 27 so that its developing roller 32 is in contact with the photosensitive belt 25.

The photosensitive belt mechanism part 29 includes a first photosensitive roller 42, a second photosensitive roller 43, a third photosensitive roller 44, a photosensitive belt 25 looped around the rollers 42 to 44, and a charger 79.

The transfer belt mechanism part 19 is disposed at a rear side of the photosensitive belt mechanism part 29, and includes a transfer belt 51 looped around a first, second, and third transfer rollers 53, 55, 57. The first transfer roller 53 is disposed in face-to-face relation with the photosensitive belt 25 such that the transfer belt 51 can contact the photosensitive belt 25. The transfer belt 51 is comprised of an endless belt formed of a conductive resin such as polycarbonate and polyimide in which conductive particles such as carbon particles are dispersed.

The transfer roller 21 is disposed face to face with the third transfer roller 57 of the transfer belt mechanism part 19 over the transfer belt 51. The transfer roller 21 is made by covering a metallic roller shaft with a roller of a conductive rubber material, and is rotatably supported. The transfer roller 21 is structured such that it can be moved by a transfer roller separation mechanism (not shown) between a standby position where it is separated from the transfer belt 51 and a transfer feasible position where it is close to the transfer belt 51. The standby position and the transfer feasible position are located face to face with each other over a paper feed path 59 for the sheet 5. At the transfer feasible position, the transfer roller 21 presses the sheet 5 passing along the paper feed path 59 against the transfer belt 51.

The transfer roller 21 is positioned at a stand-by position during printing, that is while visualized images of each color are sequentially transferred to the transfer belt 51, and positioned at a transfer capable position when all visualized images are transferred from the photosensitive belt 25 to the transfer belt 51 and then a color image is formed on the transfer belt 51. A predetermined transfer bias is to the transfer roller 21 with respect to the transfer belt 51 by a transfer bias application circuit (not shown).

The fixing part 23 is disposed at a rear of the transfer belt mechanism part 19, and includes a heat roller 61 and a pressing roller 63 that presses the heat roller 61. The heat roller 61 is made of an outer layer of silicone rubber and an inner layer of metal, and includes a halogen lamp for heating therein.

The photosensitive belt mechanism part 29 of the image forming part 9 will be described in detail. The first photosensitive roller 42 is disposed at the rear of the four cartridges 27 such as to face thereto, and at a place lower than the yellow cartridge 27Y that is positioned lowest of all. The first photosensitive roller 42 is a driven roller.

The second photosensitive roller 43 is disposed above the first photosensitive roller 42 in a vertical direction, and at a place higher than the black cartridge 27K that is positioned highest. The second photosensitive roller 43 is driven by a driving motor (not shown). The third photosensitive member roller 44 is a driven roller. The first photosensitive roller 42, the second photosensitive roller 43, and the third photosensitive roller 44 are arranged in a triangle formation.

The photosensitive belt 25 is an endless belt including a base layer of 0.08 mm thick (a conductive base layer) and a photosensitive layer of 25 μm on either side of the base layer. The base layer is formed of a nickel conductive member made by nickel electroforming. The photosensitive layer is formed of a polycarbonate-base resin photosensitive member.

Figure 4:
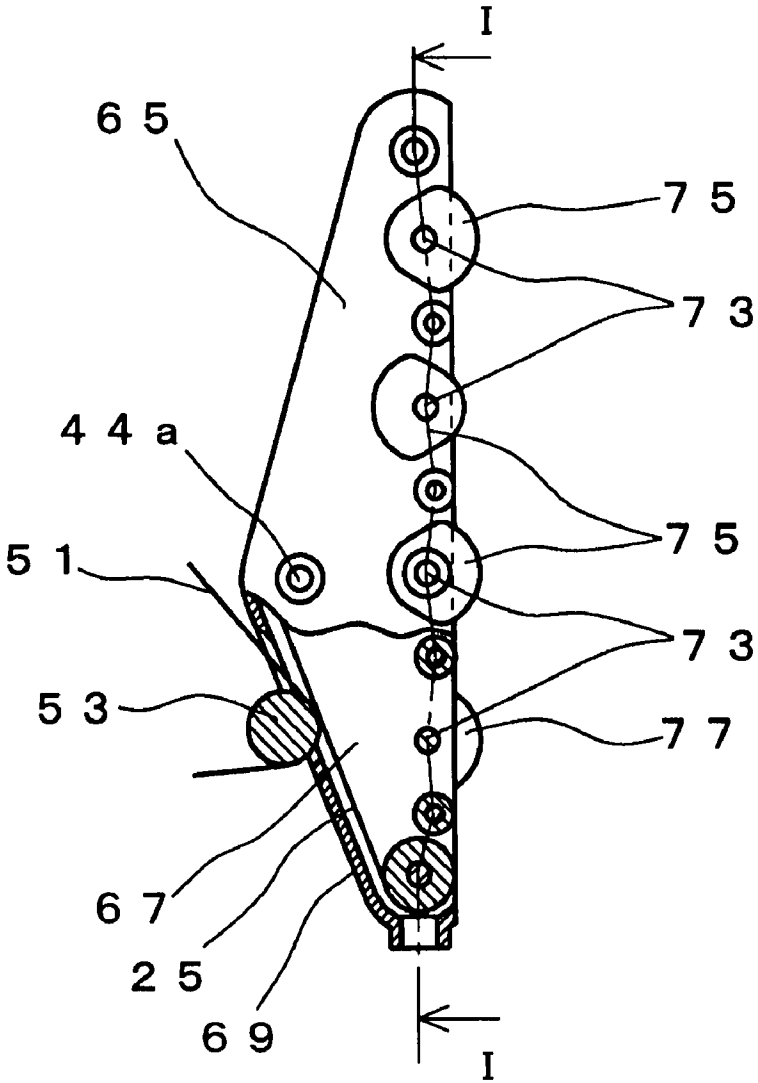
FIG. 4 is a side view of a photosensitive belt mechanism part.
Figure 5:
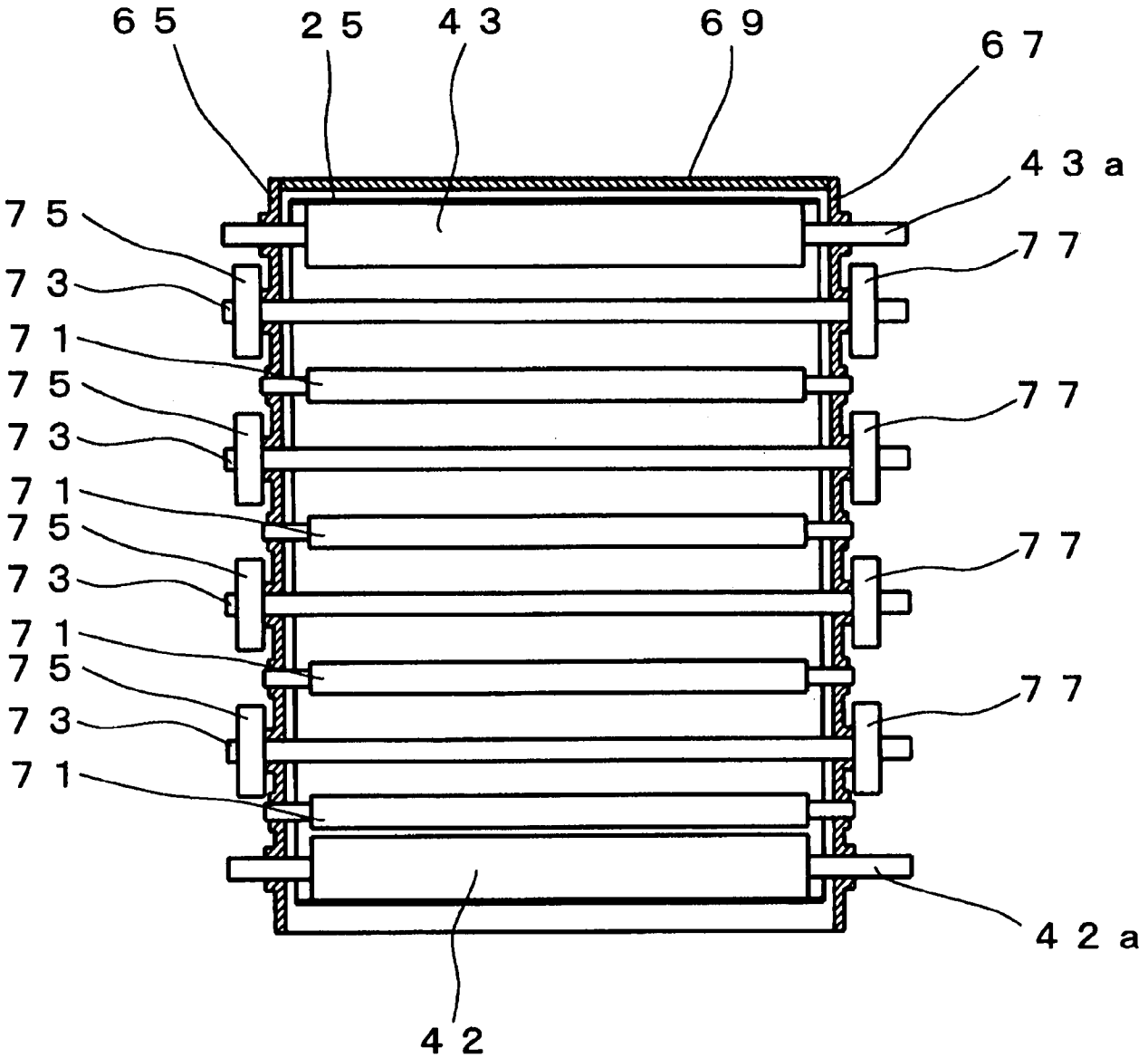
FIG. 5 is a sectional view, taken along a line I—I of FIG. 4.

First, second and third photosensitive roller shafts 42*a* to 44*a*, which support the first, second and third photosensitive rollers 42 to 44 respectively, are rotatably supported by side plates 65, 67, which are provided at both sides of the photosensitive belt 25, as shown in FIGS. 4 and 5. The side plates 65, 67 are connected by a bottom plate member 69 disposed such as to cover the periphery of the photosensitive belt 25 on an opposite side of the cartridges 27.

Four support rollers 71 are disposed inside the photosensitive belt 25, that is, in a space defined by the photosensitive belt 25 in a loop. Each support roller 71 is rotatably supported by both side plates 65, 67 and disposed in the middle of each cartridge 27 and below the yellow cartridge 27Y.

Inside the photosensitive belt 25, four rotating shafts 73 are disposed in face-to-face relation with the developing rollers 32 in each cartridge 27. Each rotating shaft 73 is rotatably supported by both side plates 65, 67, and extends outward from both side plates 65, 67 at both ends. Separation cams 75, 77 are attached to both ends of each rotating shaft 73. In the embodiment, the rotating shaft 73 and the separation cams 75, 77 function as a separation mechanism. In the embodiment, as each rotating shaft 73 is supported by the side plates 65, 67 supporting the photosensitive roller shafts 42*a* to 44*a*, the separation cams 75, 77 can be disposed precisely with respect to the photosensitive belt 25.

Figure 11:
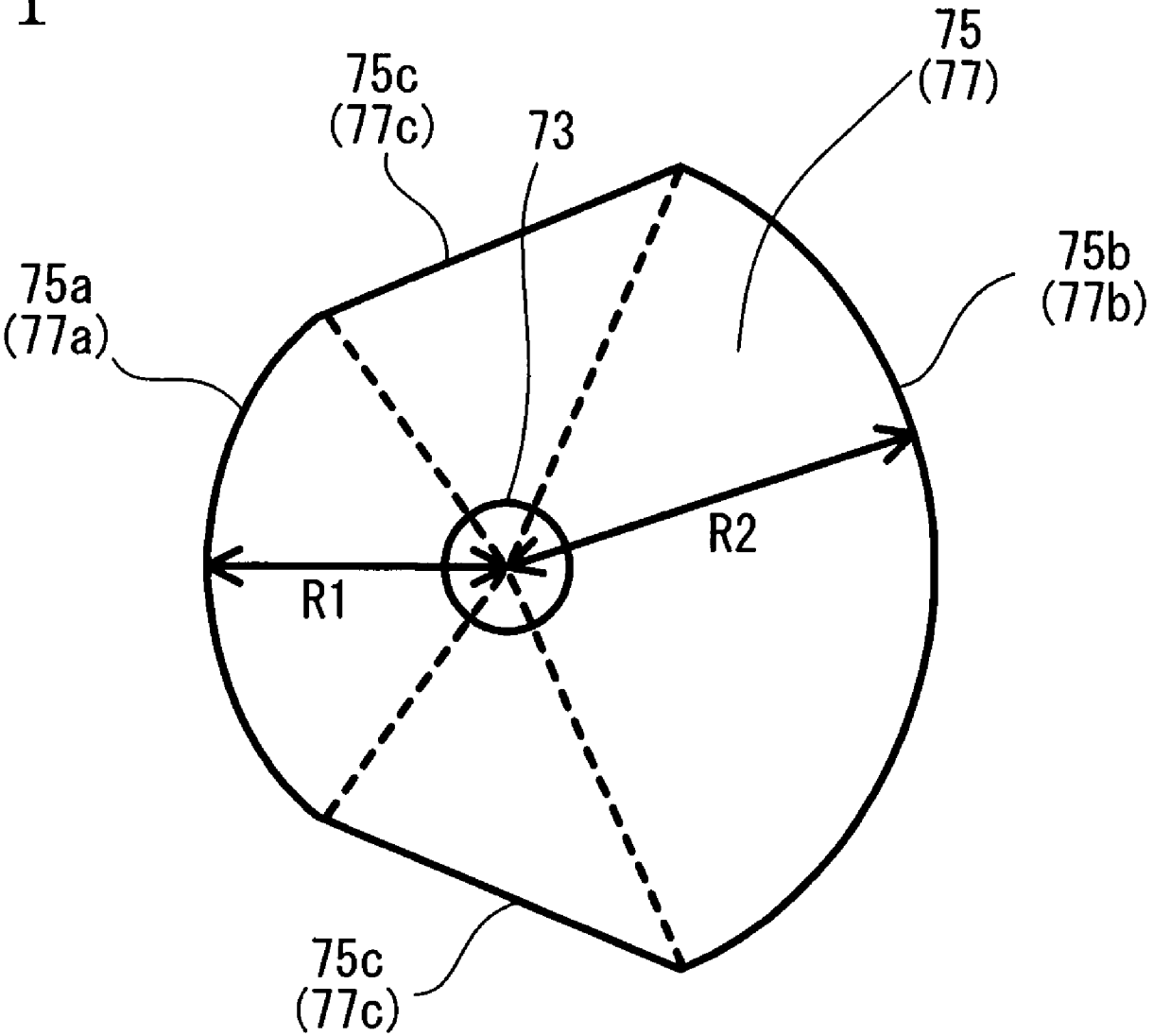
FIG. 11 is an enlarged view of a separation cam according to an embodiment of the invention.

The shape of the separation cams 75, 77 will be described with reference to FIG. 11. The circumference of each separation cam 75, 77 is made up of a first arc 75*a*, 77*a* having a radius R1 from the rotating shaft 73 regarded as the center of the cam, a second arc 75*b*, 77*b* having a radius R2 greater than R1, and straight portions 75*c*, 77*c* connecting the first arc 75*a*, 77*a* and the second arc 75*b*, 77*b*. The separation cam 75, 77 is disposed such that at least the second arc 75*b*, 77*b* can contact and engage the projecting portions 37*a*, 37*b* of the support shaft 37 of the developing roller 32.

When the separation cam 75, 77 is rotated so that the second arc 75*b*, 77*b* is brought in contact with the support shaft 37 as can be seen in the black, magenta and yellow cartridges 27K, 27M, 27Y in FIG. 1, each of the cartridges 27K, 27M, 27Y is moved against the urging force of the elastic member 41, and a clearance is formed between the photosensitive belt 25 and the developing roller 32.

When the separation cam 75, 77 is rotated 180° from the state shown in FIG. 1 where the second arc 75*b*, 77*b* contacts the support shaft 37, the first arc 75*a*, 77*a* faces the support shaft 37 as can be seen in the cyan cartridge 27C in FIG. 1. At this time, a clearance is formed between the first arc 75*a*, 77*a* and the support shaft 37, the cyan cartridge 27C is moved toward the photosensitive belt 25 by the urging force of the elastic member 41, and the developing roller 32 contacts the photosensitive belt 25. Each rotating shaft 73 is driven and rotated by a drive source, not shown, and structured such that its rotating angle can be controlled independently.

Supporting members may be attached to the projecting portions 37*a*, 37*b* so as to engage the second arc 75*b*, 77*b* of the separation cams 75, 77. The supporting members may be structured so as to slide in the grooves 39. The supporting members may be formed as resin-made caps attachable to the separation cams 75, 77.

As shown in FIG. 1, the charger 79 is disposed below the photosensitive belt mechanism part 29 and near the first photosensitive roller 42 at a predetermined distance away from the photosensitive belt 25 so as not to contact, such that the charger 79 faces an upstream side of an exposed part of the photosensitive belt 25 by the scanner unit 15. The charger 79 is a scorotron charger of a positive charge type and generates a corona discharge from a charging wire such as a tungsten wire. The charger 79 is structured to charge the surface of the photosensitive belt 25 uniformly and positively.

The operation of the color laser printer 1 will be described.

Before printing, each cartridge 27 containing each colored toner is mounted in the main body frame 3, as shown in FIG. 2. When mounting, the lid member 38 is opened, each cartridge 27 is inserted along the grooves 39 by aligning the projecting portions 37*a*, 37*b* and a protrusion 40 with the grooves 39. By closing the lid member 38, each cartridge 27 is urged toward the photosensitive belt 25 by the respective elastic member 41, the second arc 75*b*, 77*b* of each separation cam 75, 77 contacts the support shaft 37, and each developing roller 32 is located in a separation position where each developing roller 32 is spaced a predetermined distance away from the photosensitive belt 25.

When printing is started, an uppermost one of the sheets 5 accommodated in the sheet supply tray 11 of the sheet feeding unit 7 is fed one by one by the rotation of the supply roller 13. The fed sheet 5 is supplied in between the transfer roller 21 and the transfer belt 51 of the third transfer roller 57.

The surface of the photosensitive belt 25 is uniformly and positively charged by the charger 79, and then exposed to the laser beam from the scanner unit 15 by high speed scanning based on image data. In the exposed portion, electric charge disappears. Thus, on the surface of the photosensitive belt 25, an electric latent image where a portion positively charged and a portion not charged are arranged based on image data is formed.

If the electric latent image is intended for the cyan image, the rotating shaft 73 facing the cyan cartridge 27C is rotated 180°, in order to bring the developing roller 32 of the cyan cartridge 27C into contact with the photosensitive belt 25 where the latent image is formed. Accordingly, the separation cams 75, 77 are also rotated 180° as shown in FIG. 1. With this rotation, the separation cams 75, 77 are changed from the state where the second arc 75*b*, 77*b* contacts the support shaft 37 to a state where a clearance is formed between the first arc 75*a*, 77*a* and the support shaft 37. In the process of the change, the cyan cartridge 27C is moved toward the photosensitive belt 25 by the urging force of the elastic member 41, and the support shaft 37 and the projecting portions 37*a*, 37*b* are also moved toward the photosensitive belt 25 along with the cyan cartridge 27C. The developing roller 32 of the cyan cartridge 27C is moved to the development position where it contacts the photosensitive belt 25. In the development position, the support shaft 37 and the projecting portions 37*a*, 37*b* do not contact the separation cams 75, 77, and the position of the developing roller 32 never changes due to the displacement of the separation cams 75, 77. That is, as the developing roller 32 contacts the photosensitive belt 25 only with the elastic force of the elastic member 41, the development operation can be stabilized regardless of positioning accuracy.

The cyan toner contained in the cyan cartridge 27C is positively charged, and adhered only to a portion not charged of the photosensitive belt 25. As a result, a cyan toner image is formed on the photosensitive belt 25. At this time, each developing roller 32 of the magenta cartridge 27M, the yellow cartridge 27Y, and the black cartridge 27K is maintained at the separation position away from the photosensitive belt 25 for a predetermined distance.

The cyan visible image formed on the photosensitive belt 25 is transferred onto the surface of the transfer belt 51 when facing thereto with a move of the photosensitive belt 25. At this time, with an application of a forward bias to the third photosensitive roller 44, a repulsion is generated between the cyan toner positively charged and the photosensitive layer, and the cyan visible image is likely to be transferred to the transfer belt 51.

When a magenta visible image is formed, an electrostatic latent image is formed on the photosensitive belt 25, and the rotating shaft 73 facing the magenta cartridge 27M is rotated 180°. Accordingly, the separation cams 75, 77 are also rotated. With this rotation, the separation cams 75, 77 are changed from a state where the second arc 75*b*, 77*b* contacts the support shaft 37 to a state where a clearance is formed between the first arc 75*a*, 77*a* and the support shaft 37. In the process of the change, the magenta cartridge 27M is moved toward the photosensitive belt 25 by the urging force of the elastic member 41, and the support shaft 37 and the projecting portions 37*a*, 37*b* are also moved toward the photosensitive belt 25 along with the magenta cartridge 27M. The developing roller 32 of the magenta cartridge 27M is moved to the development position where it contacts the photosensitive belt 25.

On the other hand, the rotating shaft 73 facing the cyan cartridge 27C is rotated 180°, so that the separation cams 75, 77 are rotated 180°. With this rotation, the separation cams 75, 77 are changed from the state where the first arc 75*a*, 77*a* faces the support shaft 37 to the state where the second arc 75*b*, 77*b* contacts the support shaft 37. In the process of the change, the cyan cartridge 27C moves along the grooves 39 against the urging force of the elastic member 41 along with the support shaft 37. Thereby, the developing roller 32 of the cyan cartridge 27C also moves in a direction away from the photosensitive belt 25, to the separation position where the developing roller 32 is separated a predetermined distance from the photosensitive belt 25.

When the developing roller 32 is moved from the development position to the separation position, the separation cams 75, 77 are rotated, and the support shaft 37 moves along with the cartridge 27 against the urging force of the elastic member 41. Thus, the separation space between the photosensitive belt 25 and the developing roller 32 can be maintained accurately. In other words, when the developing roller 32 is in the separation position, the second arc 75*b*, 77*b* of the separation cam 75, 77 makes contact with the support shaft 37 of the developing roller 32 and there are no parts between the separation cams 75, 77 and the developing roller 32. Thus, variations in dimensional errors between a contact surface of the developing roller 32 to the photosensitive belt 25 and a contact surface of the support shaft 37 to the second arc 75*b*, 77*b*, of the separation cams 75, 77 can be minimized. Thus, the space from the photosensitive belt 25 when the developing roller is in the separation position can be maintained accurately with each cartridge 27 is used.

At this time, each developing roller 32 of the yellow cartridge 27Y, the cyan cartridge 27C and the black cartridge 27K is maintained in the separation position where it is away from the photosensitive belt 25. Thus, a magenta visible image is formed on the photosensitive belt 25 only using magenta toner contained in the magenta cartridge 27M. The magenta visible image is transferred onto the transfer belt 51 when facing thereto with a move of the photosensitive belt 25.

Similar operations are repeated by the yellow toner contained in the yellow cartridge 27Y and the black toner contained in the black cartridge 27K. Thus, each visible image of black, cyan, magenta, and yellow is transferred and overlaid one over the other on the transfer belt 51, thereby a color image is formed thereon.

The color image formed on the transfer belt 51 is transferred to the sheet 5 by the transfer roller 21 positioned in the transfer feasible position when the sheet 5 goes in between the transfer belt 51 and the transfer roller 21. The heat roller 61 of the image forming part 9 fixes the color image transferred onto the sheet 5 by heat while the sheet 5 is passing between the pressure roller 63 and the heat roller 61. The sheet 5, where the color image is fixed by heat at the fixing part 23, is conveyed to a pair of ejection rollers 81, 83. The sheet 5 conveyed to the ejection rollers 81, 83 is ejected by the ejection rollers 81, 83 and stacked on a sheet discharge tray formed at an upper portion of the main body frame 3.

The embodiment has been described as to the case where development is made when the developing roller 32 makes contact with the photosensitive belt 25. However, the embodiment is applicable for jumping development where development is made with the developing roller and the photosensitive member spaced away for a predetermined distance. The jumping development is disclosed in Japanese Laid-Open Patent Publication No. 2001-154484, for example.

Figure 6:
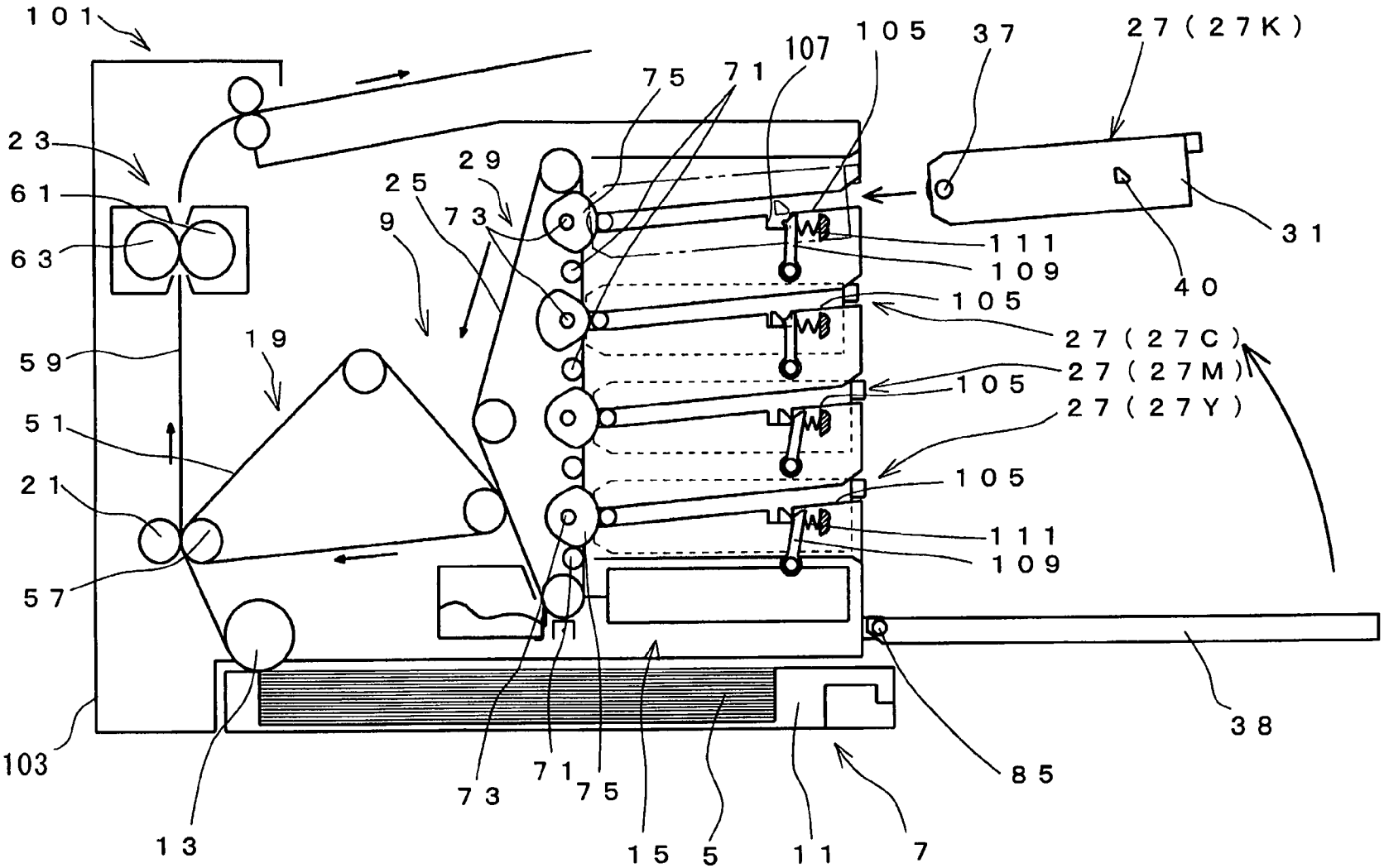
FIG. 6 is a schematic view of a color laser printer with cartridges mounted according to a second embodiment of the invention.

A second embodiment of the invention will be described as to a color laser printer 101 with reference to FIG. 6. It is noted that elements similar to or identical with those in the first embodiment are designated by similar numerals, and thus the description thereof can be omitted for the sake of brevity.

In the color laser printer 101 of the second embodiment, the major differences with the aforementioned embodiment are the arrangement of the elastic members 41 and the shape of the grooves 39 of the above embodiment. In the second embodiment, grooves 105, which are downwardly inclined toward the photosensitive belt 25, are provided in a main frame body 103. The grooves 105 are formed such that the support shaft 37 and the protrusions 40 of the cartridge 27 are slidably inserted into the grooves 105.

Each groove 105 is formed with a recess 107 in which the protrusion 40 drops when the support shaft 37 is in contact with the separation cams 75, 77. The recess 107 is designed such that the cartridge 27 is disposed horizontally when the protrusion 40 drops in the recess 107. A lever 109 is pivotally supported in the main body frame 3 for each recess 107. An elastic member 111 such as a coil spring, a spiral spring, and rubber is arranged between each lever 109 and the main body frame 103, and structured such as to urge the cartridge 27 toward the photosensitive belt 25 via the lever 109 and the protrusion 40.

Even in the second embodiment, as with the case of the first embodiment, the cartridge 27 is urged toward the photosensitive belt 25 via the lever 109 and the protrusion 40 by the elastic member 111, so that the developing roller 32 can be brought in contact with the photosensitive belt 25 in accordance with the rotation of the rotating shaft 73.

After the cartridge 27 of each color is inserted into the grooves 105, the lid member 38 is closed. In contrast to the aforementioned embodiment, as the lid member 38 is not provided with the elastic member 41, the reaction force generated by the elastic member 41 is not added to the lid member 38. When the lid member 38 is locked to the main body frame 103, it is sufficient with a mechanism capable of locking easily.

Figure 7:
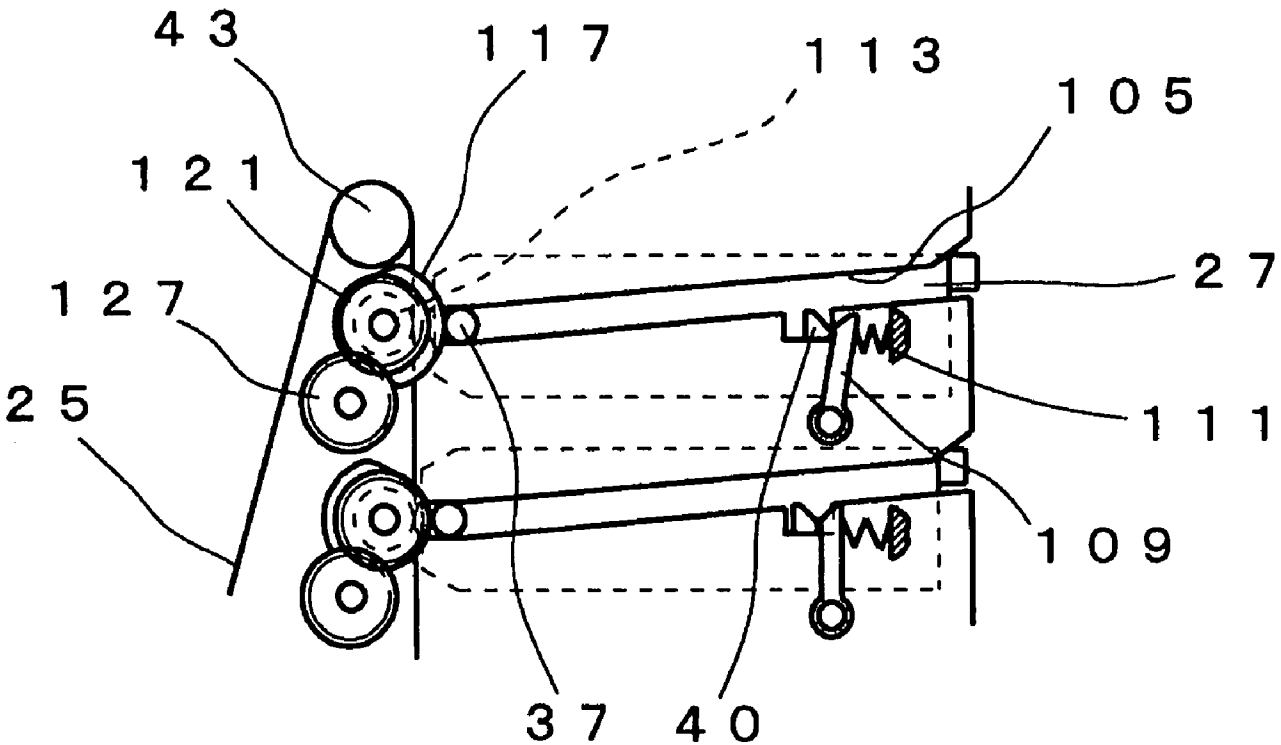
FIG. 7 is a side view of a separation cam and a groove according to a third embodiment of the invention.
Figure 8:
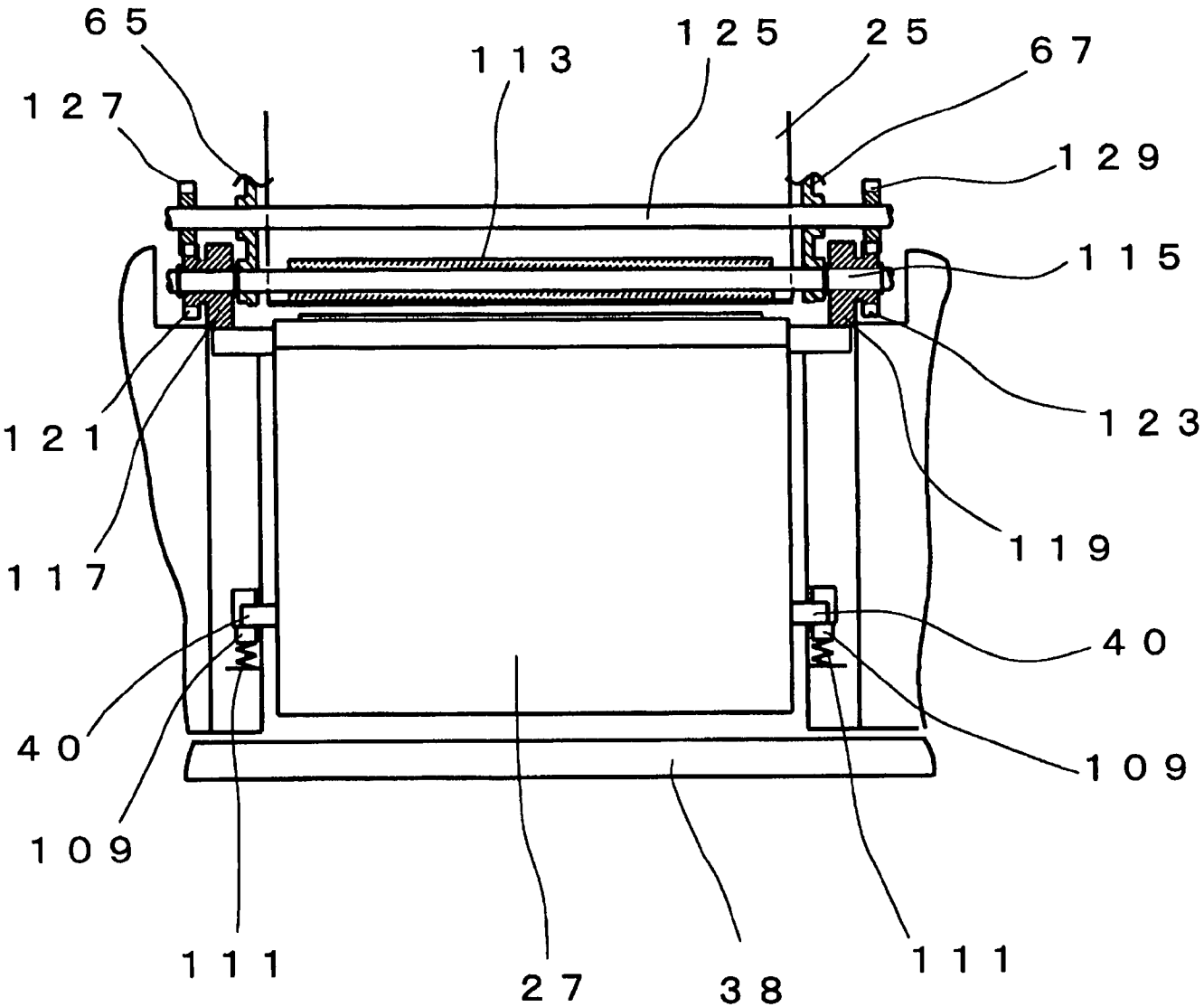
FIG. 8 is a sectional view taken along a longitudinal direction of a cartridge inserted into grooves according to the third embodiment of the invention.

A third embodiment will be described with reference to FIGS. 7 and 8. In the third embodiment, a support roller 113 is disposed opposite the developing roller 32 of the cartridge 27 via the photosensitive belt 25. A support roller shaft 115 of the support roller 113 is rotatably supported by the side plates 65, 67, and projects outside the side plates 65, 67.

Separation cams 117, 119 are rotatably mounted to the support roller shaft 115 outside the side plates 65, 67. The separation cams 117, 119 is integrally formed with gears 121, 123. An idle shaft 125 is rotatably supported by the side plates 65, 67 in parallel with the support roller shaft 115. The idle shaft 125 protrudes outside the side plates 65, 67. Idle gears 127, 129 are fixed to the idle shaft 125, and engaged with gears 121, 123, respectively.

When the idle gears 127, 129 are rotated by a drive source (not shown), the separation cams 117, 119 are rotated via the gears 121, 123. Thus, as described above, the separation cams 117, 119 move the cartridge 27 via the support shaft 37 into the separation position where the photosensitive belt 25 and the developing roller 32 are separated away at a predetermined interval. In the third embodiment, the separation cams 117, 119, the gears 121, 123, the idle shaft 125, and the idle gears 127, 129 make up a separation mechanism.

Figure 9A:
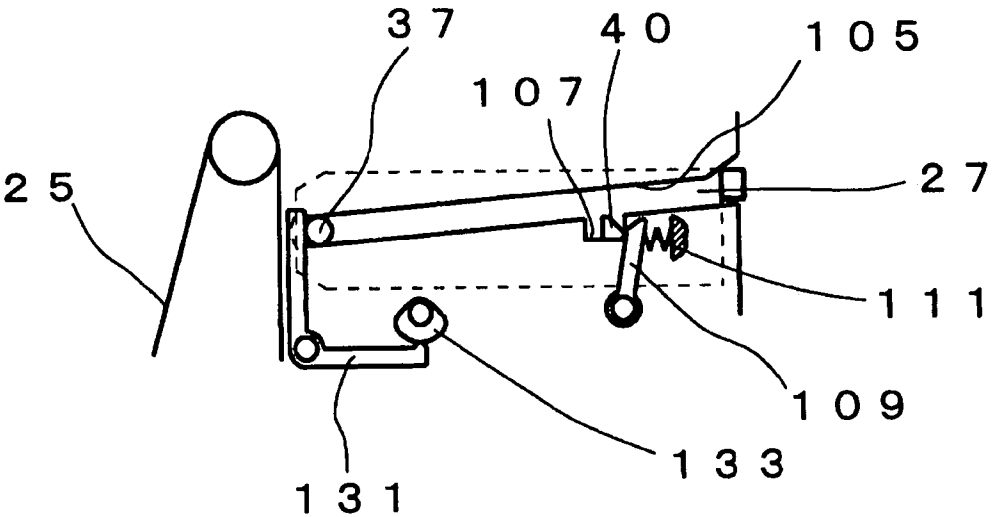
FIGS. 9A and 9B are side views of parts near a separation cam and a groove according to a fourth embodiment of the invention.

A fourth embodiment of the invention will be described with reference to FIGS. 9A and 9B. In the fourth embodiment, an L-shaped lever 131 is pivotally supported by the main body frame 3, and disposed such as to contact the support shaft 37 at one end and the separation cam 133 at the other end. As shown in FIG. 9A, when the separation cam 133 is rotated to move the lever 131, the cartridge 27 is moved via the support shaft 37 in the separation position where the developing roller 32 is separated from the photosensitive belt 25 at a predetermined interval.

Figure 9B:
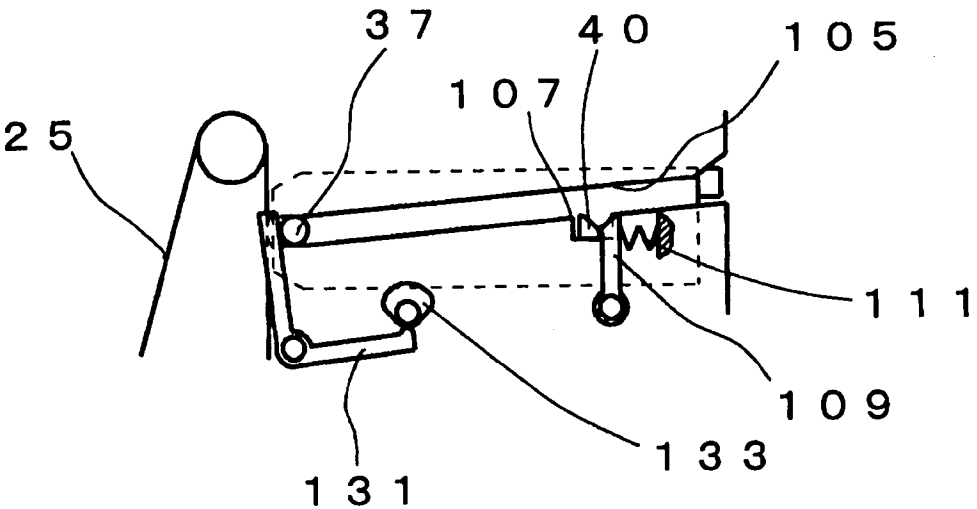

As shown in FIG. 9B, when the separation cam 133 is rotated 180°, the lever 131 is moved and the cartridge 27 is moved toward the photosensitive belt 25 by an urging force of the elastic member 111 via the lever 109 and the protrusion 40. The cartridge is located in the development position where the developing roller 32 is brought into contact with the photosensitive belt 25. In the fourth embodiment, the lever 131 and the separation cam 133 make up the separation mechanism.

Figure 10:
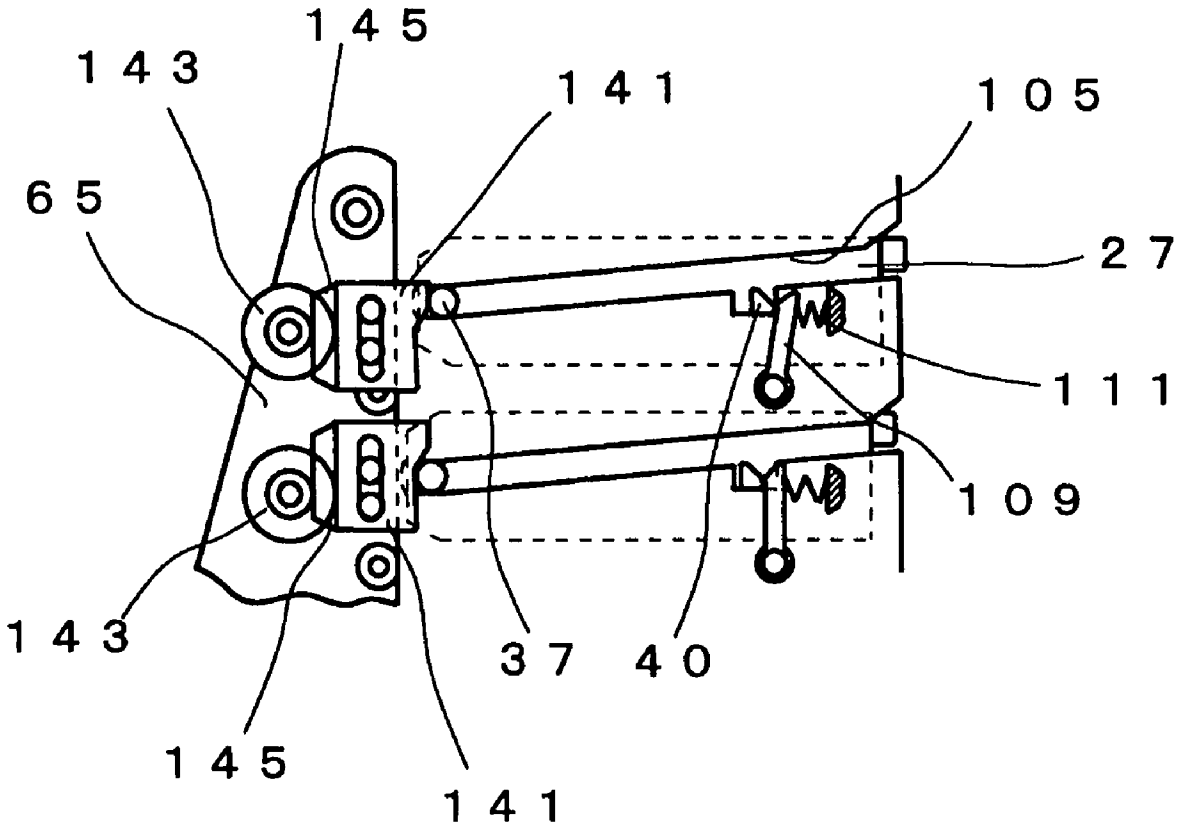
FIG. 10 is a side view of a flat-plate type separation cam and a groove according to a fifth embodiment of the invention.

A fifth embodiment of the invention will be described with reference to FIG. 10. In the fifth embodiment, a separation cam 141 is different in shape from other embodiments. The separation cam 141 is supported by the side plates 65, 67 such as to slide linearly. A gear 143 rotatably supported by the side plate 65 is engaged with a rack portion 145 formed with the separation cam 141.

When the gear 143 is rotated, the separation cam 141 slides linearly, and thus the developing roller 32 can be moved between the separation position and the development position. Even with the flat plate-type separation cam 141, it is clear that effects similar to those brought about by the aforementioned embodiments can be appreciated. The separation cam 141 and the gear 143 make up the separation mechanism.

While the invention has been described with reference to specific embodiments, the description of the specific embodiments is illustrative only and is not to be construed as limiting the scope of the invention. Various other modifications and changes may occur to those skilled in the art without departing from the spirit and scope of the invention.

What is claimed is:

1. An image forming apparatus, comprising:

a main body;

a photosensitive belt on which a latent image is formed;

a plurality of cartridges each detachably attached to the main body, each of the plurality of cartridges accommodating a different developing agent;

a plurality of developing rollers each provided at a corresponding one of the plurality of cartridges, each of the plurality of developing rollers being movable between a first position where the latent image is developed and a second position where development is not performed;

a plurality of support shafts that each rotatably support a corresponding one of the plurality of developing rollers; and a plurality of separation mechanisms that each primarily move the corresponding one of the plurality of developing rollers from the first position to the second position by engagement with a corresponding one of the plurality of support shafts.

2. The image forming apparatus according to claim 1, wherein at least a part of each of the plurality of separation mechanisms is disposed inside an endless loop formed by the photosensitive belt.

3. The image forming apparatus according to claim 2, wherein each of the plurality of separation mechanisms includes a cam member and a cam shaft that rotatably supports the cam member, the cam member contacting the corresponding one of the plurality of support shafts and moving the corresponding one of the plurality of developing rollers to the second position.

4. The image forming apparatus according to claim 3, wherein each of the plurality of support shafts includes a projecting portion extending from both sides of each of the plurality of support shafts, the cam member contacting the projecting portion and moving the corresponding one of the plurality of developing rollers to the second position.

5. The image forming apparatus according to claim 3, further comprising:

a pair of side plates provided at both sides of the photosensitive belt, the cam shaft being supported at the pair of side plates.

6. The image forming apparatus according to claim 5, further comprising:

a plurality of support rollers, provided inside of the endless loop, that support an inside of the photosensitive belt; and a plurality of support roller shafts that each rotatably support a corresponding one of the plurality of support rollers, wherein the pair of the side plates support the plurality of support roller shafts.

7. The image forming apparatus according to claim 6, wherein the plurality of support rollers face the corresponding one of the plurality of developing rollers.

8. The image forming apparatus according to claim 3, further comprising:

a plurality of elastic members that each urge a corresponding one of the plurality of cartridges so that the corresponding one of the plurality of developing rollers is at the first position.

9. The image forming apparatus according to claim 8, wherein the cam member separates from the corresponding one of the plurality of support shafts if the corresponding one of the plurality of developing rollers is at the first position.

10. The image forming apparatus according to claim 3, wherein the cam member has a first radius and a second radius that is greater than the first radius, with the second radius of the cam member contacting the projecting portion and moving the corresponding one of the plurality of developing rollers to the second position.

11. The image forming apparatus according to claim 1, wherein each of the plurality of developing rollers contacts the photosensitive belt if each of the plurality of developing rollers is at the first position, and each of the plurality of developing rollers separates from the photosensitive belt if each of the plurality of developing rollers is at the second position.

12. The image forming apparatus according to claim 1, further comprising:

a plurality of elastic members that each urge a corresponding one of the plurality of cartridges so the corresponding one of the plurality of developing rollers is at the first position.

13. The image forming apparatus according to claim 12, wherein each of the elastic member is provided at the main body.

14. The image forming apparatus according to claim 12, wherein each of the elastic members is provided at a cover that covers an opening of the main body.

15. The image forming apparatus according to claim 1, further comprising:

a plurality of elastic members that each urge a lever that urges a corresponding one of the plurality of cartridges so that the corresponding one of the plurality of developing rollers is at the first position.

16. The image forming apparatus according to claim 1, wherein each of the plurality of separating mechanisms includes a cam member and a lever, the lever contacting the corresponding one of the plurality of support shafts and moving the corresponding one of the plurality of developing rollers to the second position.

17. The image forming apparatus according to claim 1, wherein each of the plurality of separating mechanisms includes a cam member that linearly slides such that the corresponding one of the plurality of developing rollers moves to the second position.

* * * * *